US010682849B2

(12) United States Patent
Ikuta et al.

(10) Patent No.: US 10,682,849 B2
(45) Date of Patent: Jun. 16, 2020

(54) TABLET PRINTING APPARATUS AND TABLET PRINTING METHOD

(71) Applicant: SHIBAURA MECHATRONICS CORPORATION, Yokohama-shi (JP)

(72) Inventors: Ryo Ikuta, Yokohama (JP); Junsuke Komito, Yokohama (JP); Shinichi Ogimoto, Yokohama (JP)

(73) Assignee: SHIBAURA MECHATRONICS CORPORATION, Yokohama-shi (JP)

( * ) Notice: Subject to any disclaimer, the term of this patent is extended or adjusted under 35 U.S.C. 154(b) by 0 days.

(21) Appl. No.: 16/206,338

(22) Filed: Nov. 30, 2018

(65) Prior Publication Data

US 2019/0099996 A1 Apr. 4, 2019

Related U.S. Application Data

(63) Continuation of application No. PCT/JP2017/023413, filed on Jun. 26, 2017.

(30) Foreign Application Priority Data

Jun. 28, 2016 (JP) ..... 2016-128155
Jun. 20, 2017 (JP) ..... 2017-120504

(51) Int. Cl.
*B41F 17/36* (2006.01)
*B41J 3/407* (2006.01)
(Continued)

(52) U.S. Cl.
CPC ..... *B41F 17/36* (2013.01); *A61J 3/007* (2013.01); *B41J 2/135* (2013.01); *B41J 2/155* (2013.01);
(Continued)

(58) Field of Classification Search
CPC .. B41F 17/36; B41J 2/135; B41J 2/155; B41J 2/2146; B41J 3/407; B41J 3/4073; A61J 3/007; B41M 5/0088
(Continued)

(56) References Cited

U.S. PATENT DOCUMENTS 6,328,404 B1 12/2001 Fujimori
2009/0015617 A1 1/2009 Odaka et al.
(Continued)

FOREIGN PATENT DOCUMENTS

JP 7-81050 3/1995
JP 2000-225716 8/2000
(Continued)

OTHER PUBLICATIONS

International Search Report dated Jul. 25, 2017 in PCT/JP2017/023413, filed on Jun. 26, 2017.

*Primary Examiner* — Leslie J Evanisko
(74) *Attorney, Agent, or Firm* — Oblon, McClelland, Maier & Neustadt, L.L.P.

(57) ABSTRACT

According to one embodiment, a tablet printing apparatus includes a conveying device, an inkjet printing device, and a control device. The conveying device is configured to convey a tablet. The printing device includes a nozzle array in which a plurality of nozzles are arranged in a direction crossing a conveying path where the tablet is conveyed by the conveying device, and performs printing by ejecting ink from the nozzles to the tablet being conveyed by the conveying device. The control device increases either one of a resolution in the conveying direction of the tablet at the time of performing the printing and a resolution in the array direction of the nozzles at the time of performing the
(Continued)

printing higher than the other according to a print density or a print shape on the tablet, and controls the printing device to perform the printing.

20 Claims, 10 Drawing Sheets

(51) Int. Cl.

| | |
|---|---|
| ***A61J 3/00*** | (2006.01) |
| ***B41J 11/00*** | (2006.01) |
| ***B41M 5/00*** | (2006.01) |
| ***B41J 2/135*** | (2006.01) |
| ***B41J 2/21*** | (2006.01) |
| ***B41J 2/155*** | (2006.01) |

(52) U.S. Cl.
CPC ..... *B41J 2/2146* (2013.01); *B41J 3/407* (2013.01); *B41J 11/007* (2013.01); *B41M 5/0088* (2013.01)

(58) Field of Classification Search
USPC ..... 400/120.09, 120.1; 101/35, 37, 41
See application file for complete search history.

(56) References Cited

U.S. PATENT DOCUMENTS

| | | | | |
|---|---|---|---|---|
| 2011/0128557 | A1* | 6/2011 | Kinoshita ..... | A61J 3/007 358/1.5 |
| 2016/0021907 | A1 | 1/2016 | Cavin et al. | |
| 2017/0259595 | A1 | 9/2017 | Aoyagi et al. | |

FOREIGN PATENT DOCUMENTS

| | | |
|---|---|---|
| JP | 2009-18534 | 1/2009 |
| KR | 10-2006-0040031 | 5/2006 |
| WO | WO2016/084812 | 6/2016 |

* cited by examiner

X600×Y600

X600×Y600

X600×Y300

X1200×Y300

TABLET PRINTING APPARATUS AND TABLET PRINTING METHOD

CROSS-REFERENCE TO THE RELATED APPLICATION

This application is based upon and claims the benefit of priority from International Application No. PCT/JP2017/023413, filed on Jun. 26, 2017; Japanese Patent Applications No. 2016-128155, filed on Jun. 28, 2016 and No. 2017-120504, filed on Jun. 20, 2017; the entire contents of all of which are incorporated herein by reference.

FIELD

Embodiments described herein relate generally to a tablet printing apparatus and a tablet printing method.

BACKGROUND

A tablet printing apparatus is used to print identification information such as letters or characters (alphabet, kana character, number, etc.) and marks (symbol, figure, etc.) on the surface of a tablet for identifying the tablet. As such tablet printing apparatuses, those that perform printing on tablets in a noncontact manner have been developed due to the ease of changing identification information, high print quality, and the like. An inkjet tablet printing apparatus is configured to eject ink (for example, edible ink) toward tablets while conveying them by a conveyor belt, thereby printing identification information on the surfaces of the tablets. The legibility of the identification information printed on the surface of each tablet is influenced by the density of ink dots formed thereon by the ink ejection from the inkjet head, namely resolution.

The inkjet head of the tablet printing apparatus includes an array of nozzles that are arranged perpendicularly to the tablet conveying direction (hereinafter also simply referred to as "conveying direction") in the horizontal plane. In tablet printing by the inkjet head, the resolution in the conveying direction according to the tablet conveying speed is determined by the control of timing of the ink ejection from the nozzles of the inkjet head according to the tablet conveying speed. On the other hand, the resolution in a direction perpendicular to the conveying direction is determined by the nozzle pitch in the nozzle array direction. The minimum value of the nozzle pitch of the nozzle array is determined by a limit in processing. Therefore, in order to increase the resolution in the direction perpendicular to the conveying direction, a method of arranging nozzle rows is adopted. Specifically, a plurality of nozzle arrays is used and the nozzles in the nozzle arrays are shifted to be placed in a staggered arrangement (zigzag arrangement) with respect to the conveying direction. For example, nozzles in the second array are each located to face the middle of the nozzle pitch of the nozzle array in the first array.

When printing is performed with the use of a plurality of nozzle arrays as described above, the position and posture (for example, inclination, orientation, etc.) of each tablet may change due to the vibration of the conveyor belt or the like while the tablet moves between the nozzle arrays. In particular, the longer the distance between the nozzle arrays used for printing, the more the position and posture of the tablet are likely to change during printing. A change in the position or posture of the tablet during printing causes a shift in the print position on the tablet where a print is applied by the inkjet head. Accordingly, identification information printed on the tablet is not clear, and the legibility thereof is reduced. As compared to ordinary printing, legibility is important for printing of identification information on tablets. Low legibility can lead to, for example, the misreading of information (such as the type and amount (dose) of medicine) printed on tablets, resulting in misuse of the medicine.

DETAILED DESCRIPTION

According to one embodiment, a tablet printing apparatus includes a conveying device, an inkjet printing device, and a control device. The conveying device is configured to convey a tablet. The printing device includes a nozzle array in which a plurality of nozzles are arranged in a direction crossing a conveying path where the tablet is conveyed by the conveying device, and performs printing by ejecting ink from the nozzles to the tablet being conveyed by the conveying device. The control device increases either one of a resolution in the conveying direction of the tablet at the time of performing the printing and a resolution in the array direction of the nozzles at the time of performing the printing higher than the other according to a print density or a print shape on the tablet, and controls the printing device to perform the printing.

According to another embodiment, a tablet printing method includes: conveying a tablet by a conveying device; and ejecting ink from a plurality of nozzles of an inkjet printing device to the tablet being conveyed by the conveying device to perform printing. The printing device includes a nozzle array in which the nozzles are arranged in a direction crossing a conveying path where the tablet is conveyed by the conveying device. For the printing, a control device increases either one of a resolution in the conveying direction of the tablet at the time of performing the printing and a resolution in the array direction of the nozzles higher at the time of performing the printing than the other according to a print density or a print shape on the tablet, and controls the printing device to perform the printing.

An embodiment will be described with reference to drawings.

(Basic Configuration)

Figure 1:
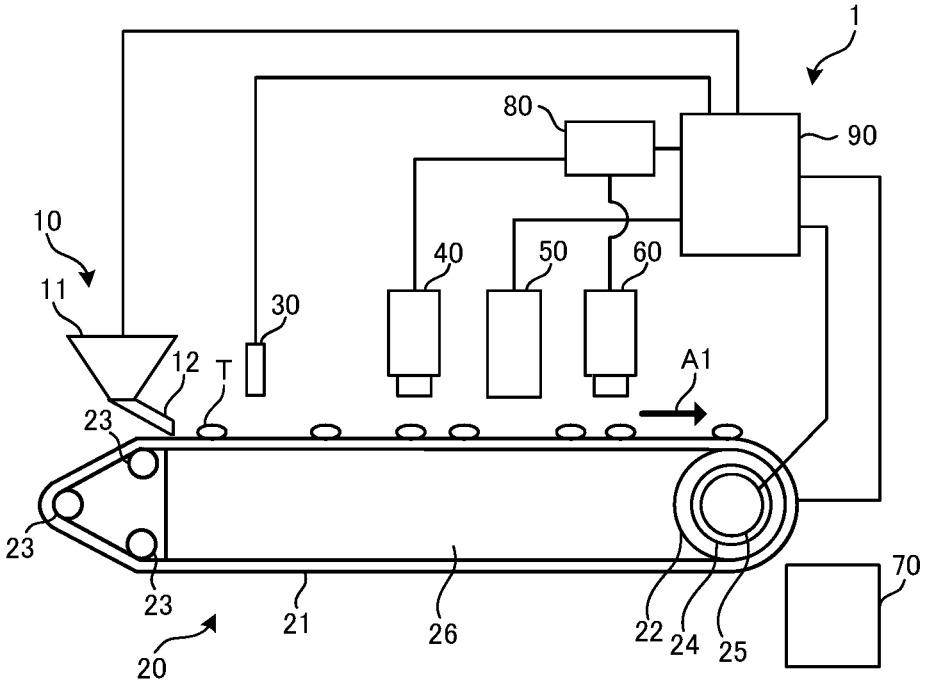
FIG. 1 is a diagram illustrating the schematic configuration of a tablet printing apparatus according to a first embodiment.

As illustrated in FIG. 1, a tablet printing apparatus 1 of the first embodiment includes a supply device (supplier) 10, a conveying device (conveyor) 20, a detecting device (detector) 30, a first imaging device (imager) 40, a printing device (printer) 50, a second imaging device (imager) 60, a collecting device (collector) 70, an image processing device (image processor) 80, and a control device (controller) 90. The supply device 10 includes a hopper 11 and a chute 12. The hopper 11 stores a number of tablets T and sequentially supplies the tablets T to the chute 12. The chute 12 aligns the supplied tablets T in a row and supplies them to the conveying device 20. The supply device 10 is electrically connected to the control device 90, and is driven under the control of the control device 90.

The conveying device 20 includes a conveyor belt 21, a driving pulley 22, a plurality of driven pulleys 23 (three in the example of FIG. 1), a motor (driving unit) 24, a position detector 25, and a suction chamber (suction unit) 26. The conveyor belt 21 is an endless belt, and wrapped around the driving pulley 22 and the driven pulleys 23. The driving pulley 22 and the driven pulleys 23 are rotatable, and the driving pulley 22 is connected to the motor 24. The motor 24 is electrically connected to the control device 90, and is driven under the control of the control device 90. The position detector 25 is a device such as an encoder and is attached to the motor 24. The position detector 25 is electrically connected to the control device 90, and sends a detection signal to the control device 90. The control device 90 can obtain information such as the position, speed, and movement amount of the conveyor belt 21 based on the detection signal. In the conveying device 20, the conveyor belt 21 rotates together with the driven pulleys 23 due to the rotation of the driving pulley 22 caused by the motor 24, and tablets T on the conveyor belt 21 are conveyed in the direction of arrow A1 in FIG. 1 (conveying direction A1).

Figure 2:
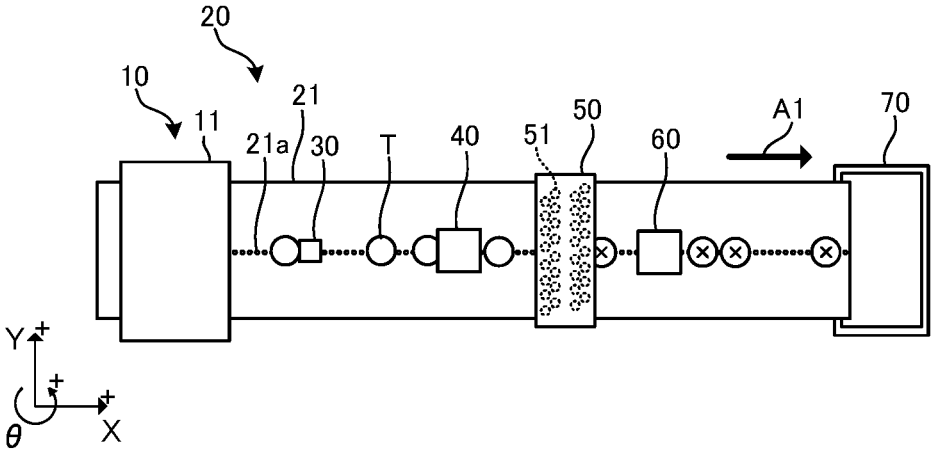
FIG. 2 is a plan view of a part of the tablet printing apparatus of the first embodiment.

As illustrated in FIG. 2, a plurality of circular suction holes 21*a* are formed in the surface of the conveyor belt 21. The suction holes 21*a* are through holes for sucking and holding the tablets T, and are arranged in a row along the conveying direction A1 so as to form a conveying path. Each of the suction holes 21*a* is connected to the suction chamber 26 (see FIG. 1) to obtain suction force from the suction chamber 26. The suction chamber 26 is connected to a suction device (not illustrated) such as a pump through a suction pipe (not illustrated) such as a duct. The inside of the suction chamber 26 is sucked by the suction device through the suction pipe. Thereby, the tablets T each placed on the suction holes 21*a* of the conveyor belt 21 are held on the conveyor belt 21 as being sucked by the suction chamber 26.

Referring back to FIG. 1, the detecting device 30 is located on the downstream side of the position where the supply device 10 is located in the conveying direction A1, and is arranged above the conveyor belt 21. The detecting device 30 detects the position (the position in the conveying direction A1) of the tablet T on the conveyor belt 21 by projecting and receiving laser beams, and functions as a trigger sensor of each device located on the downstream side. As the detecting device 30, various laser sensors such as reflection laser sensors can be used. The detecting device 30 is electrically connected to the control device 90, and sends a detection signal to the control device 90.

The first imaging device 40 is located on the downstream side of the position where the detecting device 30 is located in the conveying direction A1, and is arranged above the conveyor belt 21. The first imaging device 40 performs imaging at the time when the tablet T reaches just under it based on the position information of the tablet T to capture an image (image for printing) including the upper surface of the tablet T, and sends the image to the control device 90. As the first imaging device 40, various cameras having an imaging device such as a charge-coupled device (CCD) or a complementary metal-oxide semiconductor (CMOS) can be used. The first imaging device 40 is electrically connected to the control device 90 via the image processing device 80, and is driven under the control of the control device 90. There may also be provided an illumination for imaging as necessary.

Figure 3:
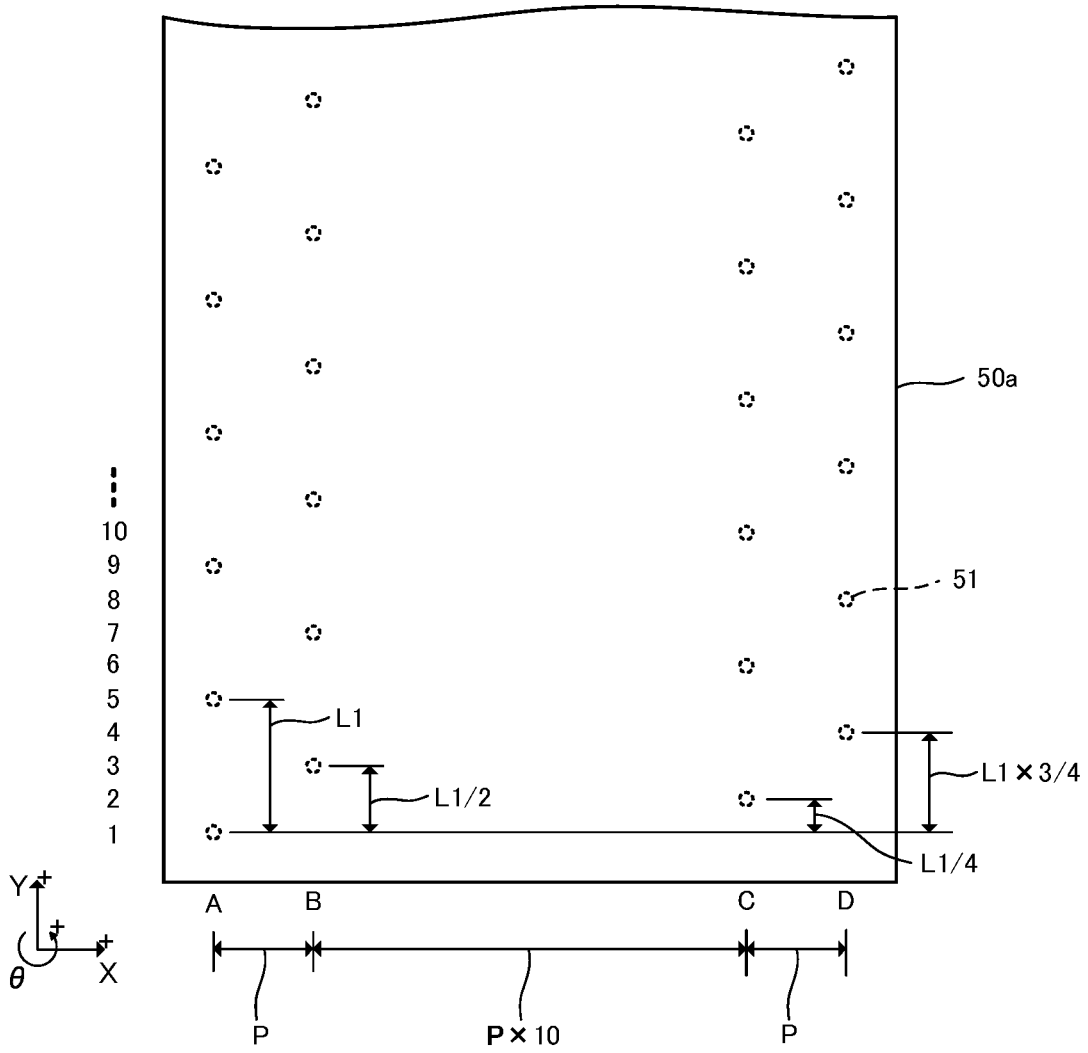
FIG. 3 is a plan view of an inkjet head that constitutes a printing device of the first embodiment.

The printing device 50 includes an inkjet head 50*a* (see FIG. 3). The printing device 50 is located on the downstream side of the position where the first imaging device 40 is located in the conveying direction A1, and is arranged above the conveyor belt 21. The inkjet head 50*a* has a plurality of nozzles 51 (see FIG. 2), and ejects ink from the nozzles 51 individually. The inkjet head 50*a* is arranged such that the array direction of the nozzles 51 crosses (for example, perpendicularly to) the conveying direction A1 in the horizontal plane. As the inkjet head 50*a*, various inkjet print heads having a drive element such as a piezoelectric element, a heating element, a magnetostrictive element or the like can be used. The printing device 50 is electrically connected to the control device 90, and is driven under the control of the control device 90.

The second imaging device 60 is located on the downstream side of the position where the printing device 50 is located in the conveying direction A1, and is arranged above the conveyor belt 21. The second imaging device 60 performs imaging at the time when the tablet T reaches just under it based on the position information of the tablet T to capture an image (image for inspection) including the upper surface of the tablet T, and sends the image to the control device 90. Similarly to the first imaging device 40, various cameras having an imaging device such as CCD or CMOS can be used as the second imaging device 60. The second imaging device 60 is electrically connected to the control device 90, and is driven under the control of the control device 90. There may also be provided an illumination for imaging as necessary.

The collecting device 70 is located on the downstream side of the position where the second imaging device 60 is located in the conveying direction A1. The collecting device 70 is arranged at the end of the conveying device 20 on the downstream side in the conveying direction A1. The collecting device 70 is capable of receiving the tablets T that are released from the hold of the conveying device 20 and sequentially dropped to collect them. The conveying device 20 releases the hold of each tablet T when the tablet T reaches a desired position such as, for example, the end of the conveying device 20 on the downstream side in the conveying direction A1.

The image processing device 80 receives an image for detecting the position of each tablet captured by the first imaging device 40 and an image for inspecting print state (condition) captured by the second imaging device 60, and processes the images by using a known image processing technique.

For example, the image processing device 80 processes the image for detecting the position of each tablet received from the first imaging device 40, and detects the position of the tablet T in the X direction (the conveying direction A1), the Y direction, and the θ direction (see FIG. 2). The positions in the X direction and the Y direction refer to, for example, positions in the XY coordinate system with respect to the center of the field of view of the first imaging device 40. The position in the e direction refers to, for example, a position indicating the degree of rotation of the tablet T with respect to the center line of the field of view of the first imaging device 40 in the Y direction. The position in the θ direction is detected when the tablet T has a directional property as in the case where the tablet T has a split line or the tablet T is in an elliptical shape, an oval shape, a quadrangular shape, or the like. In addition, the image processing device 80 processes the image for inspecting print state received from the second imaging device 60, and detects the print position and shape of a print pattern (for example, a letter or a character, a mark, etc.) printed on the tablet T.

The image processing device 80 sends the position information of each tablet T in the X direction, the Y direction, and the θ direction and the print position information and the shape information of the print pattern on the each tablet T thus detected to the control device 90. When the each information is sent, the image processing device 80 adds identification information of the imaging device or 60 to the each information and sends it. With this, the control device 90 can figure out whether the received information corresponds to the imaging device 40 or 60.

The control device 90 includes a microcomputer (not illustrated) that intensively controls each unit and a storage (not illustrated) that stores process information, various programs, and the like. The control device 90 controls the supply device 10, the conveying device 20, the first imaging device 40, the printing device 50, the second imaging device 60, and the image processing device 80 based on various information and various programs. The control device 90 also receives detection signals and the like sent from the detecting device 30 and the position detector 25.

For example, based on the position information of the tablet T in the X direction, the Y direction, and the θ direction received from the image processing device 80, the control device 90 sets printing conditions for the tablet T whose positions in the X direction, the Y direction, and the θ direction have been detected. Incidentally, the storage stores print data including a print pattern such as a letter, a character, or a mark, the print position of the print pattern on the tablets T, data on the moving speed of the conveyor belt 21, and the like. The control device 90 determines the use range of the nozzles 51 in the inkjet head 50*a* of the printing device 50 used for printing of this time based on the position information of the tablet T in the Y direction. The control device 90 also determines the timing at which printing is started on the tablet T based on the position information of the tablet T in the X direction. Further, the control device 90 sets printing conditions correspondingly to the position of the tablet T in the θ direction based on the position information of the tablet T in the θ direction. As an example, 180 types of print data are obtained by rotating a print pattern 1 degree by 1 degree in the range of 0 to 179 degrees, and are stored in the storage of the control device 90 in advance. The control device 90 selects print data with an angle that matches the position in the θ direction from these pieces of print data to set the printing conditions.

Further, the control device 90 determines whether the print pattern (for example, a letter or a character, a mark, etc.) is properly printed on the tablet T based on the print position information and the shape information of the print pattern on the tablet T received from the image processing device 80. Specifically, the control device 90 compares the print pattern printed on the tablet T with a correct print pattern stored therein in advance to make this determination. When the control device 90 determines that the print pattern is properly printed on the tablet T, the tablet T has passed the inspection and is collected by the collecting device 70. On the other hand, if the control device 90 determines that the print pattern is not properly printed on the tablet T, the tablet T has failed the inspection, and is blown by air to be collected by a container other than the collecting device 70.

(Printing Device 50)

Next, the printing device 50 will be described in detail.

As illustrated in FIG. 3, the inkjet head 50*a* of this embodiment has four nozzle arrays A, B, C, and D. In each of the nozzle arrays A, B, C, and D, the nozzles 51 are aligned in a row in the Y direction. The direction in which the nozzles 51 are arranged is the array direction of the nozzles 51. In FIG. 3, the arrangement positions of the nozzles are denoted by reference numerals (1, 2, 3, 4 . . . ). The nozzle arrays A and B have odd numbered nozzles 51 and the nozzle arrays C and D have even numbered nozzles 51. Specifically, in the nozzle array A, the nozzles 51 are located in reference numbers 1, 5, 9, . . . . In the nozzle array B, the nozzles 51 are located in reference numbers 3, 7, . . . . In the nozzle array C, the nozzles 51 are located in reference numbers 2, 6 . . . . In the nozzle array D, the nozzles 51 are located in reference numbers 4, 8, . . . . In this manner, the nozzles 51 are arranged in in every fourth number in each array. Each of the nozzles 51 is set to constantly eject the same amount of ink, and all the nozzles 51 eject the same or nearly the same amount of ink.

The separation distance (separation distance in the X direction) between the nozzle arrays A and B is set to P. Similarly, the separation distance (separation distance in the X direction) between the nozzle arrays C and D is set to P. Besides, the separation distance (separation distance in the X direction) between the nozzle arrays B and C is set to P×10. In other words, the separation distance between the nozzle arrays B and C is 10 times the separation distance P between the nozzle arrays A and B or between the nozzle arrays C and D. This is because the nozzle arrays B and C must be separated by a large distance due to the structure of the inkjet head 50*a* (due to the structure for supplying ink to each of the nozzles 51, for ejecting ink from the nozzles 51 individually, etc.).

Assuming that the nozzles 51 are arranged at a nozzle pitch (separation distance) L1 in the nozzle arrays A, B, C, D as illustrated in FIG. 3, the nozzle array B is shifted by L1/2 in the +Y direction with respect to the nozzle array A. The nozzle array C is shifted by L1/4 in the +Y direction with respect to the nozzle array A. The nozzle array D is shifted by L1×3/4 in the +Y direction with respect to the nozzle array A. As described above, the nozzle arrays A, B, C, and D are arranged so as to be shifted from one another in the array direction of the nozzles 51 (Y direction). That is, the nozzles 51 of the nozzle arrays A, B, C, and D are in a staggered arrangement (zigzag arrangement).

The density of ink dots (resolution) formed on the surface of the tablet T by the ink ejection from the inkjet head 50*a* is defined by the density of ink dots (resolution) in the conveying direction A1 of the tablets T (X direction) and the density of ink dots (resolution) in a direction (Y direction) crossing the conveying direction A1 of the tablets T (X direction). In other words, the density of ink dots (resolution) formed on the surface of the tablet T is determined by the pitch (separation distance) between ink dots in the X direction and the pitch (separation distance) between ink dots in the Y direction. The pitch between ink dots in the X direction (X-direction resolution) depends on the ejection of ink at a timing (time interval) according to the conveying speed of the tablets T to land the ink to the surface of each of the tablets T. The conveying speed of the tablets T is determined in consideration of the printing processing capability, and is set to be constant during printing. The pitch between ink dots in the Y direction (Y-direction resolution) depends on the nozzle pitch in the array direction of the nozzles 51. Therefore, the resolution of printing is determined by the position (nozzle position) where ink is ejected at the time of printing and the timing. The position and timing of ink ejection depend on a dot pattern to eject the ink. That is, the resolution of printing is determined by the resolution of the dot pattern.

In the inkjet head 50*a*, the nozzle arrays A, B, C, and D are shifted from one another such that the nozzles 51 are arranged in a zigzag manner. With this, the resolution in the array direction of the nozzles 51 (Y direction) can be 600 dpi at the maximum. By using the nozzle arrays A and B or the nozzle arrays C and D in combination, the resolution in the array direction of the nozzles 51 is set to 300 dpi. Besides, by using one of the nozzle arrays A, B, C, and D alone, the resolution in the array direction of the nozzles 51 is set to 150 dpi. In this manner, the resolution in the array direction of the nozzles 51 can be changed by selecting the nozzle array(s) to be used.

Figure 4:
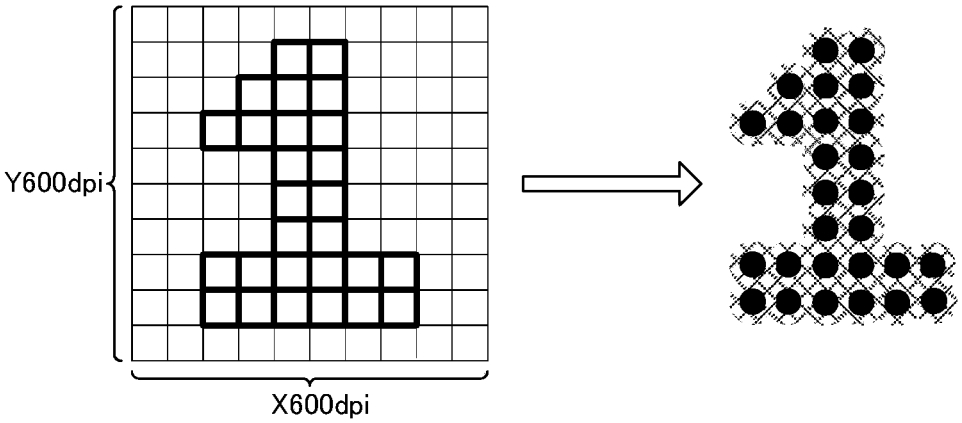
FIG. 4 is a diagram illustrating a print pattern of X: 600 dpi×Y: 600 dpi, and identification information printed based on the print pattern according to the first embodiment.
Figure 5:
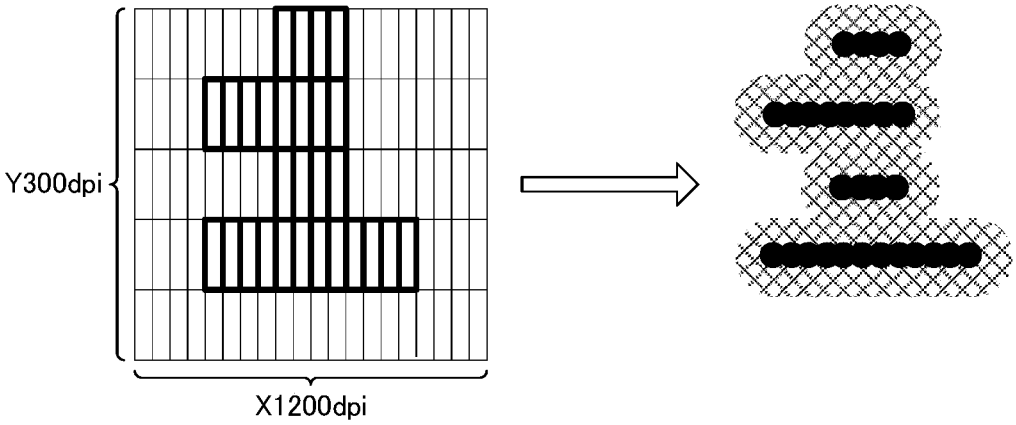
FIG. 5 is a diagram illustrating a print pattern of X: 1200 dpi×Y: 300 dpi, and identification information printed based on the print pattern according to the first embodiment.

In this embodiment, For example, as shown in FIG. 4, a print pattern of X: 600 dpi×Y: 600 dpi is used as a first print pattern in which the resolution in the conveying direction A1 of the tablets T (hereinafter also simply referred to as "X-direction resolution") and the resolution in the array direction of the nozzles 51 (hereinafter also simply referred to as "Y-direction resolution") are the same. When printing is performed based on the first print pattern, all the four nozzle arrays A, B, C, D (see FIG. 3) are used for printing to achieve a Y-direction resolution of 600 dpi. Incidentally, "X: 600 dpi×Y: 600 dpi" means 600 dpi resolution in the X direction×600 dpi resolution in the Y direction (the same applies hereinafter). As shown in FIG. 5, a print pattern of X: 1200 dpi×Y: 300 dpi is used as a second print pattern in which the X-direction resolution is higher than the Y-direction resolution. When printing is performed based on the second print pattern, the two nozzle arrays A and B (the odd numbered nozzles 51) are used for printing to achieve a Y-direction resolution of 300 dpi. The matrix illustrated in FIGS. 4 and 5 is a schematic representation of the resolution of the print pattern (dot pattern). In the figure, the vertical direction corresponds to the Y-direction resolution, while the horizontal direction corresponds to the X-direction resolution. The bold-framed cells in the matrix indicate dots where ink is to be applied. In addition, on the right side in FIGS. 4 and 5, dots of ink that has landed on the tablet T are represented by black circles, and the spread of the ink is represented by meshes. This illustration indicates that the ink landed to the tablet T gradually spreads and the dots of the ink are combined together.

The control device 90 selects nozzle arrays to be used for printing from among the nozzle arrays A, B, C, and D based on the first print pattern or the second print pattern. That is, when a print pattern (the first print pattern or the second print pattern) used for printing is set, the control device 90 selects nozzle arrays to be used from all the nozzle arrays A, B, C, and D according to the resolution of the print pattern.

In the case of the print pattern of X: 1200 dpi×Y: 300 dpi, the Y-direction resolution is half of that of the print pattern of X: 600 dpi×Y: 600 dpi, but the X-direction resolution is doubled to compensate it. Accordingly, with the print pattern of X: 1200 dpi×Y: 300 dpi, the number of ink dots in a predetermined area decreases (in this case, halved) in the Y direction and increases (in this case, doubled) in the X direction as compared to the print pattern of X: 600 dpi×Y: 600 dpi, and therefore the number of ink dots in the predetermined area in the both patterns can be considered the same. In other words, the density of ink dots landed to the tablet T is halved in the Y direction and is doubled in the X direction. Thereafter, as illustrated on the right side in FIG. 5, the ink on the tablet T gradually spreads. At this time, the ink also spreads in the Y direction, i.e., in the array direction of the nozzles 51. The areas of ink dots landed on the tablet T adjacent to each other in the array direction of the nozzles 51 are combined together, and thus identification information "1" is formed. In this manner, the identification information "1" illustrated on the right side in FIG. 5 is printed as clear as that illustrated on the right side of FIG. 4 (details will be described later).

As described above, each of the nozzles 51 is set to constantly eject the same amount of ink, and all the nozzles 51 eject the same or nearly the same amount of ink. Therefore, the total amount of ink ejected to one tablet T is determined by the number of times of ink ejection. There is no difference in the total amount of ink ejected to one tablet T between the first print pattern and the second print pattern of this embodiment.

(Generation of Print Pattern)

Figure 6:
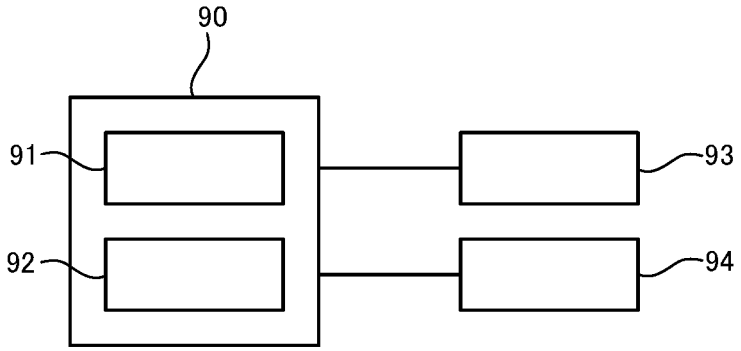
FIG. 6 is a diagram illustrating the schematic configuration of a control device of the first embodiment.

Next, a procedure of generating a print pattern will be described. As illustrated in FIG. 6, the control device 90 includes a resolution setting unit (setter) 91 configured to set resolution and a pattern generating unit (generator) 92 configured to generate a print pattern (dot pattern). The control device 90 is electrically connected to an input unit (equipment) 93 configured to receive an input provided by an operator and a display 94 configured to display images. The control device 90, the resolution setting unit 91, and the pattern generating unit 92 may be realized only by hardware such as a circuit, or may be realized by both hardware and software. The input unit 93 is realized by, for example, a keyboard, a mouse, an input circuit, and the like. The display 94 is realized by, for example, a liquid crystal display, a display circuit, or the like.

Figure 7:
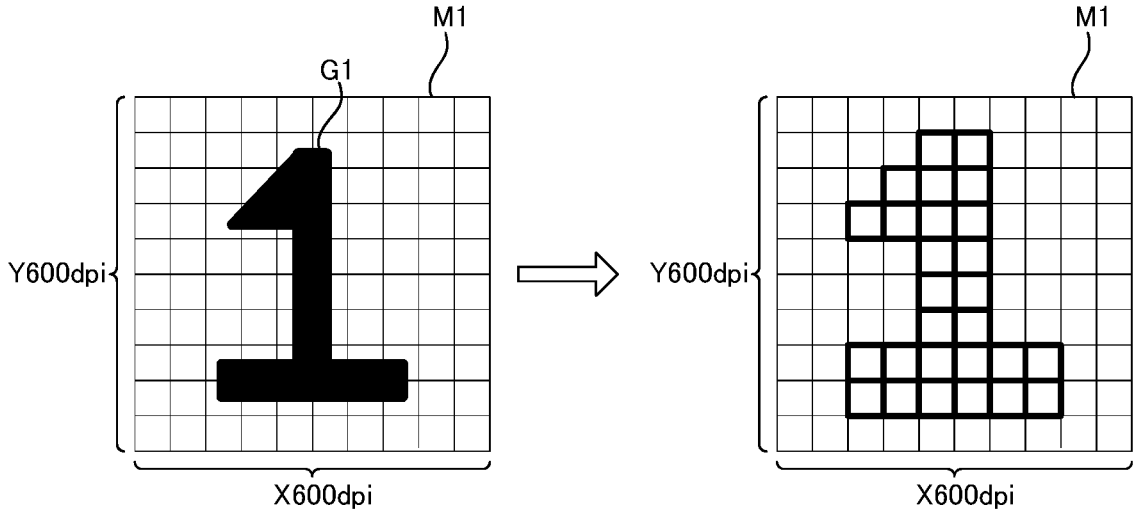
FIG. 7 is a diagram for explaining a print pattern generation process of the first embodiment.

First, the operator enters identification information such as a letter, a character, or a mark by operating the input unit 93, and the control device 90 stores the identification information as an image. The operator also enters a resolution by using the input unit 93, and the resolution setting unit 91 sets the resolution according to the input. For example, when the resolution setting unit 91 sets the resolution to X: 600 dpi×Y: 600 dpi, the pattern generating unit 92 overlays the entered image (input image) G1 on a matrix M1 corresponding to the resolution "X: 600 dpi×Y: 600 dpi" as illustrated in FIG. 7. Then, according to a predetermined rule, the pattern generating unit 92 converts a portion corresponding to the input image G1 in the matrix M1 of X: 600 dpi×Y: 600 dpi into a dot pattern (see the bold-framed cells of the right matrix in FIG. 7), thereby generating a print pattern that represents the dot pattern. Thereafter, print data (ejection data) is generated according to the print pattern generated, and printing is performed based on the print data. In the dot pattern conversion described above, for example, unit areas where the input image G1 overlaps in the matrix M1 are sequentially selected, and thereby the input image G1 is converted into a dot pattern. This dot pattern conversion is, for example, a conversion process based on a program; however, it is not limited thereto.

When the resolution is changed, for example, when the resolution is changed from X: 600 dpi×Y: 600 dpi to X: 1200 dpi×Y: 300 dpi, the pattern generating unit 92 generates a print pattern of X: 1200 dpi×Y: 300 dpi in the same manner as described above. That is, the pattern generating unit 92 generates a print pattern to be used according to the resolution entered.

If the dot pattern generated by the matrix of X: 600 dpi×Y: 600 dpi is reused as a dot pattern of X: 1200 dpi×Y: 300 dpi, for example, the print is deformed and not clear. When a dot pattern of X: 600 dpi×Y: 600 dpi is generated from an image, the part where ink dots are applied in the matrix is determined to achieve clear print results. Specifically, for example, when a line of the image runs across a plurality of cells of the matrix, the cells where ink dots are applied are selected to achieve clear print results. In the case of reusing the dot pattern obtained in this manner, the dots are added or reduced, resulting in the deformation of the print shape. Therefore, in order to change the resolution, a dot pattern is newly generated according to a matrix of the resolution. With this, the dot pattern suitable for printing is obtained. Further, reliable and fast processing can be achieved as compared to the case of reusing the same dot pattern.

In the resolution setting described above, the first print pattern or the second print pattern, or the arbitrary combination of the X-direction resolution and the Y-direction resolution, or the like can be set appropriately based on past printing results and the like. Further, for example, an image for print check (print check image) may be displayed on the display 94. In this case, the operator can check the print density or the print shape while viewing the print check image to enter the resolution by using the input unit 93. The resolution setting unit 91 sets the resolution according to the input of the resolution. The operator can also adjust the density (for example, a value of gray scale or a percentage of density) by using the input unit 93 while viewing the print check image. The resolution setting unit 91 sets the resolution according to the adjustment of the density. As a result, the resolution setting unit 91 sets the resolution according to the print density or the print shape on the tablets T. The print density refers to the density (color intensity) of a letter, a character, a mark, or the like printed on the tablets T. The print shape refers to the shape of a letter, a character, a mark, or the like printed on the tablets T. A new print pattern is generated according to the resolution changed, and the operator checks the appearance (density and shape) of the print again while viewing a print check image corresponding to the new print pattern. The appearance of the print need not necessarily be checked with the print check image displayed on the display 94, and may be checked at another place (off-machine, offline).

In addition, correlation between the print resolution and the print density may be obtained in advance, and setting for the adjustment of the resolution and the print density can be performed based on the correlation. For example, in the ink prepared as a reference and the tablets T, or the ink to be used and the tablets T to be printed, using a reference print shape or a print shape (a letter or a character, a mark, etc.) to be used for printing, correlation data may be generated to be stored in advance by changing the resolution in the conveying direction A1 of the tablets T at regular intervals and measuring the print density with an inspection device (for example, the second imaging device 60) of the apparatus. As the correlation data, a correlation table indicating the correlation between the X-direction resolution (resolution in the conveying direction A1 of the tablets T) and the print density can be used. With this, correlation can be derived from correlation data in various inks and the tablets T as well as print shapes. By using the correlation, an input reference value can be presented on the display 94 at the time of inputting the density. Further, the selected value of the resolution with respect to the input value of the density or the prediction of changes in density as to the input value of the density can also be presented on the display 94. Incidentally, the check of the print density includes the check of the spread degree of ink.

(Specific Printing Operations)

Next, specific printing operations of the printing device 50 will be described. For example, a description will be given of the case where a first straight line extending in the Y direction is printed on the tablet T that is moving as conveyed by the conveyor belt 21 with reference to FIGS. 8 and 9. Then, a description will be given of the case where a second straight line extending in the Y direction is printed (printing of the vertical line of the number "1" in FIGS. 4 and 5) with reference to FIGS. 10 and 11.

In the upper diagram of FIGS. 8 to 11 illustrating the ejection timing, vertically aligned numbers indicate the numbers of the nozzles 51 arranged in the Y direction (corresponding to the reference numerals in FIG. 3), horizontally aligned alphabets indicate the nozzle arrays A, B, C, and D, and black circles B1 indicate the ejection timing of the nozzles. Besides, in the lower diagram illustrating changes in print state, dots of ink applied are indicated by black circles, and the spread of the ink is indicated by a mesh. In FIGS. 8 to 11, the spacing between the nozzle arrays A, B, C, and D is schematically illustrated. It is assumed in FIGS. 8 to 11 that each of the nozzles 51 is set to constantly eject the same amount of ink, and all the nozzles 51 eject the same or nearly the same amount of ink.

(First Printing Operation)

Figure 8:
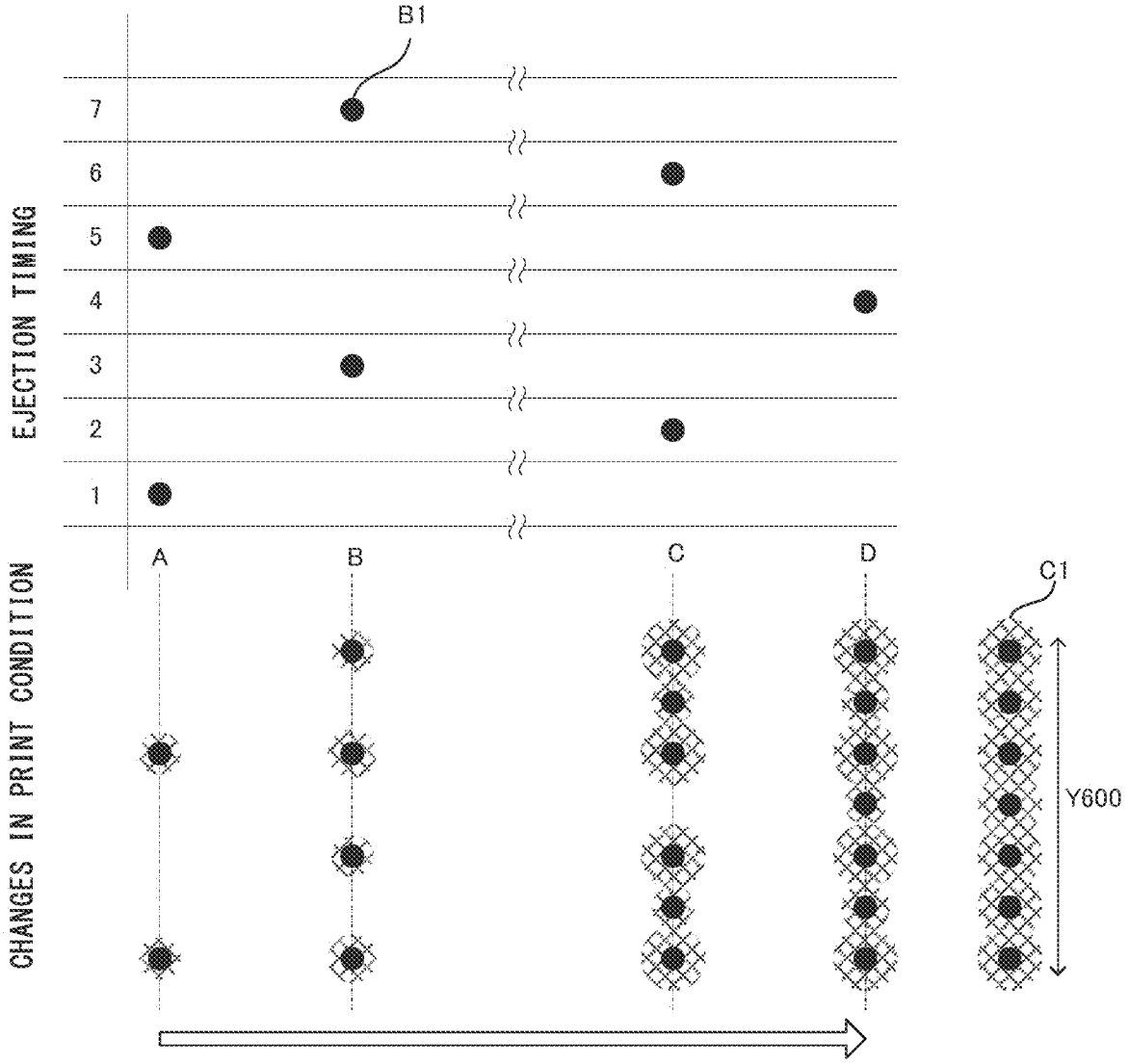
FIG. 8 is a diagram for explaining a first printing operation in which all nozzle arrays are used according to the first embodiment.

FIG. 8 illustrates an example in which ink is ejected from each of the nozzles 51 to the tablet T that is moving as conveyed by the conveyor belt 21 using all the nozzle arrays A, B, C, and D to print a straight line C1 as the first straight line extending in the Y direction. The printing of the straight line C1 is performed using a print pattern with a resolution of 600 dpi in the Y direction.

First, when the tablet T arrives just under the nozzle array A, ink is ejected from the nozzles 51 in the numbers 1 and 5 in the nozzle array A. Thereby, two ink dots are formed on the surface of the tablet T, and the ink spreads from these ink dots. The ink stops spreading when it has spread to some extent (the same applies to other ink dots). Then, when the tablet T has moved by the separation distance P (see FIG. 3)

from under the nozzle array A, and arrives just under the nozzle array B, ink is ejected from the nozzles 51 in the numbers 3 and 7 in the nozzle array B. As a result, in addition to the two ink dots formed by the nozzle array A, two ink dots are formed on the surface of the tablet T, and the ink spreads from these ink dots.

Thereafter, when the tablet T has moved by the separation distance P×10 from under the nozzle array B, and arrives just under the nozzle array C, ink is ejected from the nozzles 51 in the numbers 2 and 6 in the nozzle array C. As a result, in addition to the four ink dots formed by the nozzle arrays A and B, two ink dots are formed on the surface of the tablet T, and the ink spreads from these ink dots. Further, when the tablet T has moved by the separation distance P from under the nozzle array C, and arrives just under the nozzle array D, ink is ejected from the nozzle 51 in the number 4 in the nozzle array D. As a result, in addition to the six ink dots formed by the nozzle arrays A, B and C, one ink dot is formed on the surface of the tablet T, and the ink spreads from the ink dot.

In the example of FIG. 8, the ink applied to the tablet T gradually spreads as described above, and the regions of ink dots adjacent in the array direction of the nozzles 51 (Y direction) are combined. Thus, the straight line C1 extending in the Y direction is printed on the tablet T.

(Second Printing Operation)

Figure 9:
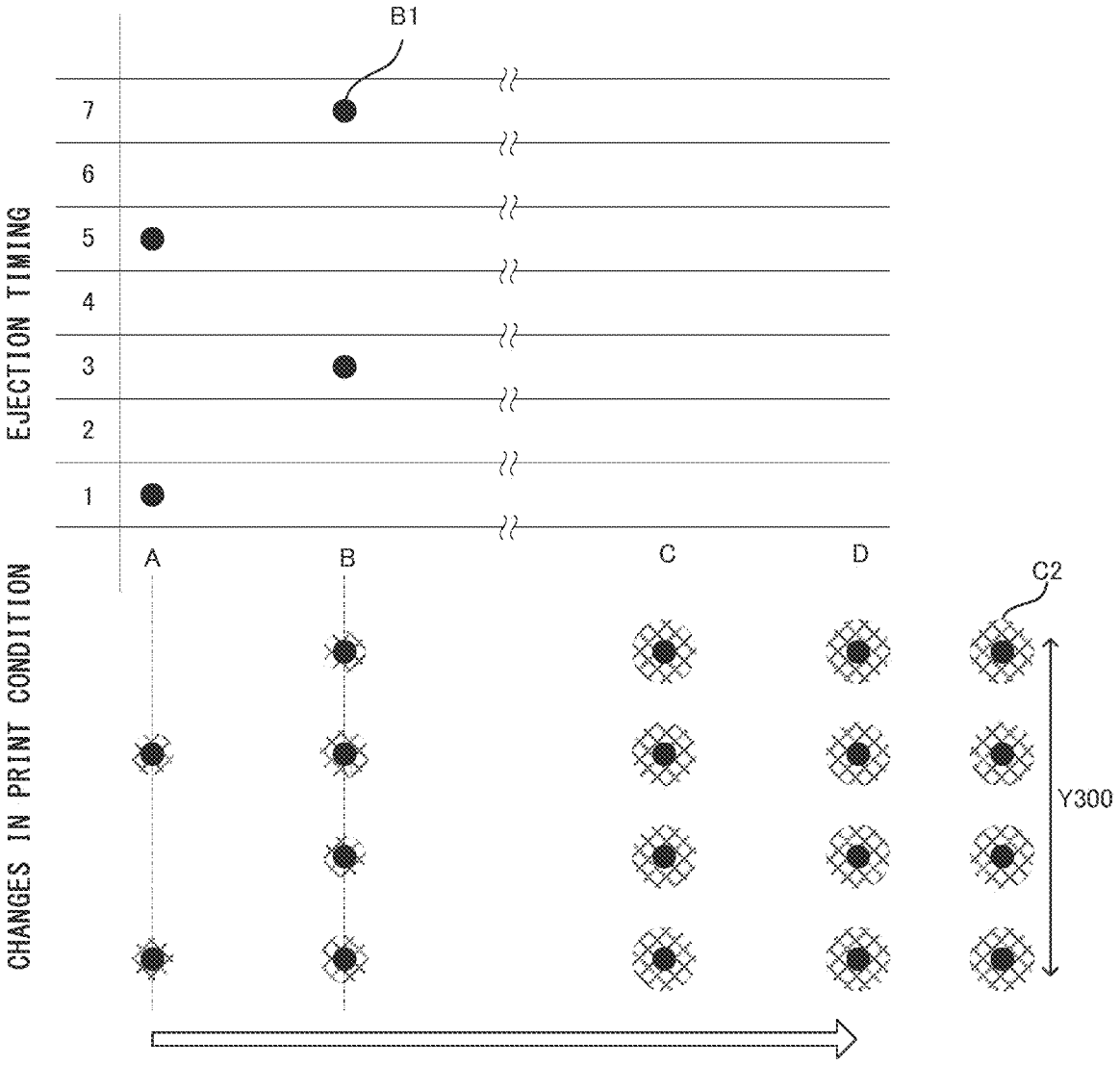
FIG. 9 is a diagram for explaining a second printing operation in which two nozzle arrays are used according to the first embodiment.

FIG. 9 illustrates an example in which ink is ejected from each of the nozzles 51 to the tablet T that is moving as conveyed by the conveyor belt 21 using two nozzle arrays A and B to print a straight line C2 as the first straight line extending in the Y direction. The printing of the straight line C2 is performed using a print pattern with a resolution of 300 dpi in the Y direction.

First, when the tablet T arrives just under the nozzle array A, ink is ejected from the nozzles 51 in the numbers 1 and 5 in the nozzle array A. Thereby, two ink dots are formed on the surface of the tablet T, and the ink spreads from these ink dots. Then, when the tablet T has moved by the separation distance P from under the nozzle array A, and arrives just under the nozzle array B, ink is ejected from the nozzles 51 in the numbers 3 and 7 in the nozzle array B. As a result, in addition to the two ink dots formed by the nozzle array A, two ink dots are formed on the surface of the tablet T, and the ink spreads from these ink dots.

In the example of FIG. 9, although the ink applied to the tablet T gradually spreads as described above, the regions of ink dots adjacent in the array direction of the nozzles 51 (Y direction) are not to be combined. Accordingly, the straight line C2 extending in the Y direction is printed coarsely on the tablet T.

(Third Printing Operation)

Figure 10:
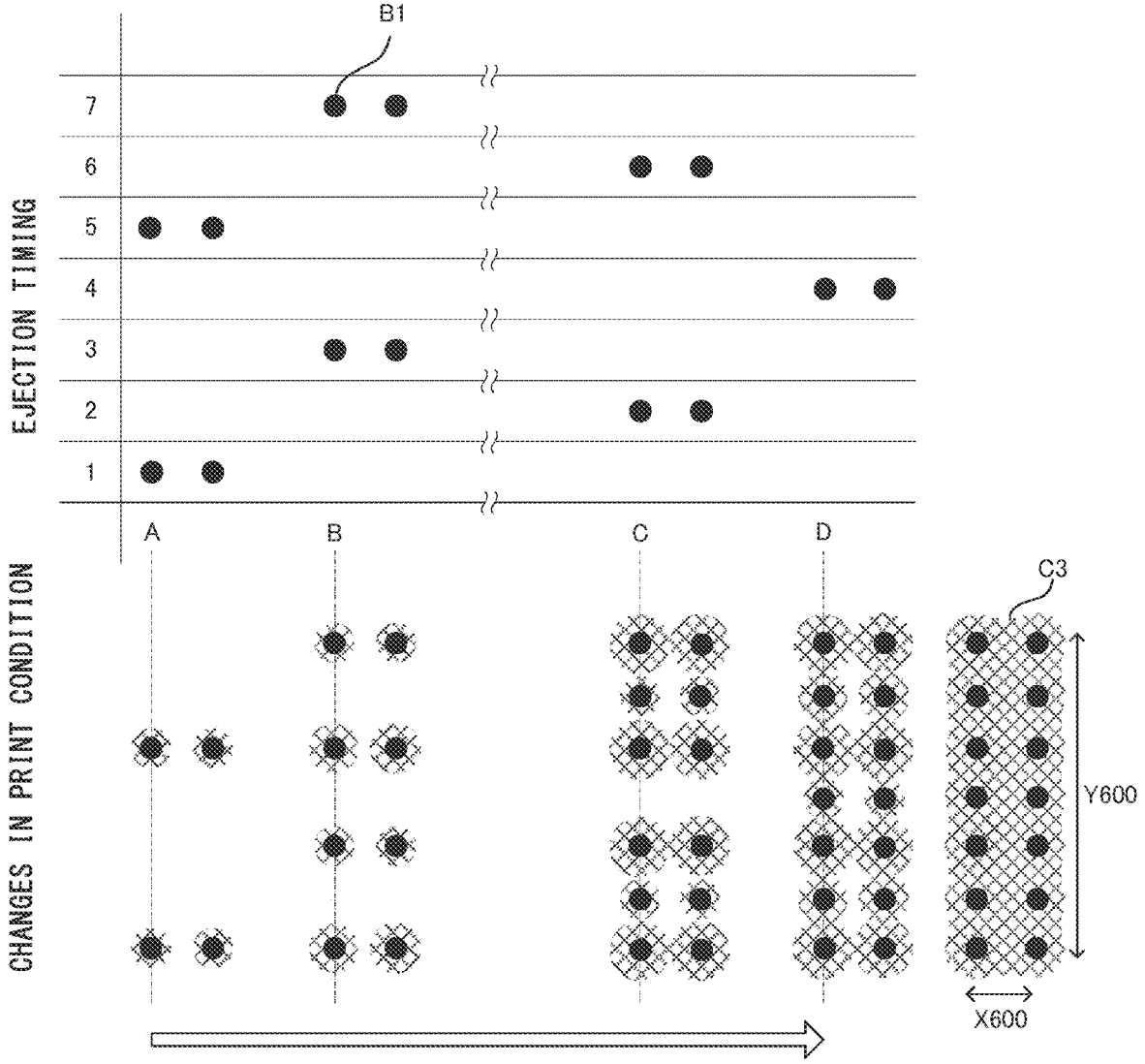
FIG. 10 is a diagram for explaining a third printing operation in which all nozzle arrays are used according to the first embodiment.

FIG. 10 illustrates an example in which ink is ejected from each of the nozzles 51 to the tablet T that is moving as conveyed by the conveyor belt 21 using all the nozzle arrays A, B, C, and D to print a straight line C3 (X: 600 dpi×Y: 600 dpi) as the second straight line extending in the Y direction. The printing of the straight line C3 is performed using a print pattern with a resolution of 600 dpi in the X and Y directions. In the example of FIG. 10, ink is ejected from the nozzle arrays A, B, C, and D at a predetermined timing for achieving a resolution of X: 600 dpi. The predetermined timing is obtained based on the time interval determined by the conveying speed (moving speed) of the tablet T and the pitch (separation distance) of ink dots at the X-direction resolution.

First, when the tablet T arrives just under the nozzle array A, ink is ejected from the nozzles 51 in the numbers 1 and 5 in the nozzle array A. Then, ink is ejected again from the nozzles 51 in the numbers 1 and 5 at a predetermined timing. Thus, ink ejection is performed twice in total from the nozzle array A. Thereby, four ink dots are formed on the surface of the tablet T, and the ink spreads from these ink dots. After that, when the tablet T has moved by the separation distance P from under the nozzle array A, and arrives just under the nozzle array B, ink is ejected from the nozzles 51 in the numbers 3 and 7 in the nozzle array B. Then, ink is ejected again from the nozzles 51 in the numbers 3 and 7 at a predetermined timing. Thus, ink ejection is performed twice in total from the nozzle array B. As a result, in addition to the four ink dots formed by the nozzle array A, four ink dots are formed on the surface of the tablet T, and the ink spreads from these ink dots.

Thereafter, when the tablet T has moved by the separation distance P×10 from under the nozzle array B, and arrives just under the nozzle array C, ink is ejected from the nozzles 51 in the numbers 2 and 6 in the nozzle array C. Then, ink is ejected again from the nozzles 51 in the numbers 2 and 6 at a predetermined timing. Thus, ink ejection is performed twice in total from the nozzle array C. As a result, in addition to the eight ink dots formed by the nozzle arrays A and B, four ink dots are formed on the surface of the tablet T, and the ink spreads from these ink dots. Further, when the tablet T has moved by the separation distance P from under the nozzle array C, and arrives just under the nozzle array D, ink is ejected from the nozzle 51 in the number 4 in the nozzle array D. Then, ink is ejected again from the nozzle 51 in the number 4 at a predetermined timing. Thus, ink ejection is performed twice in total from the nozzle array D. As a result, in addition to the twelve ink dots formed by the nozzle arrays A, B, and C, two ink dots are formed on the surface of the tablet T, and the ink spreads from these ink dots.

In the example of FIG. 10, ink ejection is performed from the nozzle arrays A, B, C, and D at a timing for achieving a resolution of X: 600 dpi as described above. Thereby, dots are printed at intervals of 600 dpi in the X direction (conveying direction A1) in two adjacent rows. The ink dots are combined as the ink spreads, and finally form a straight line C3 extending in the Y direction. Thus, the straight line C3 extending in the Y direction is printed on the tablet T.

(Fourth Printing Operation)

Figure 11:
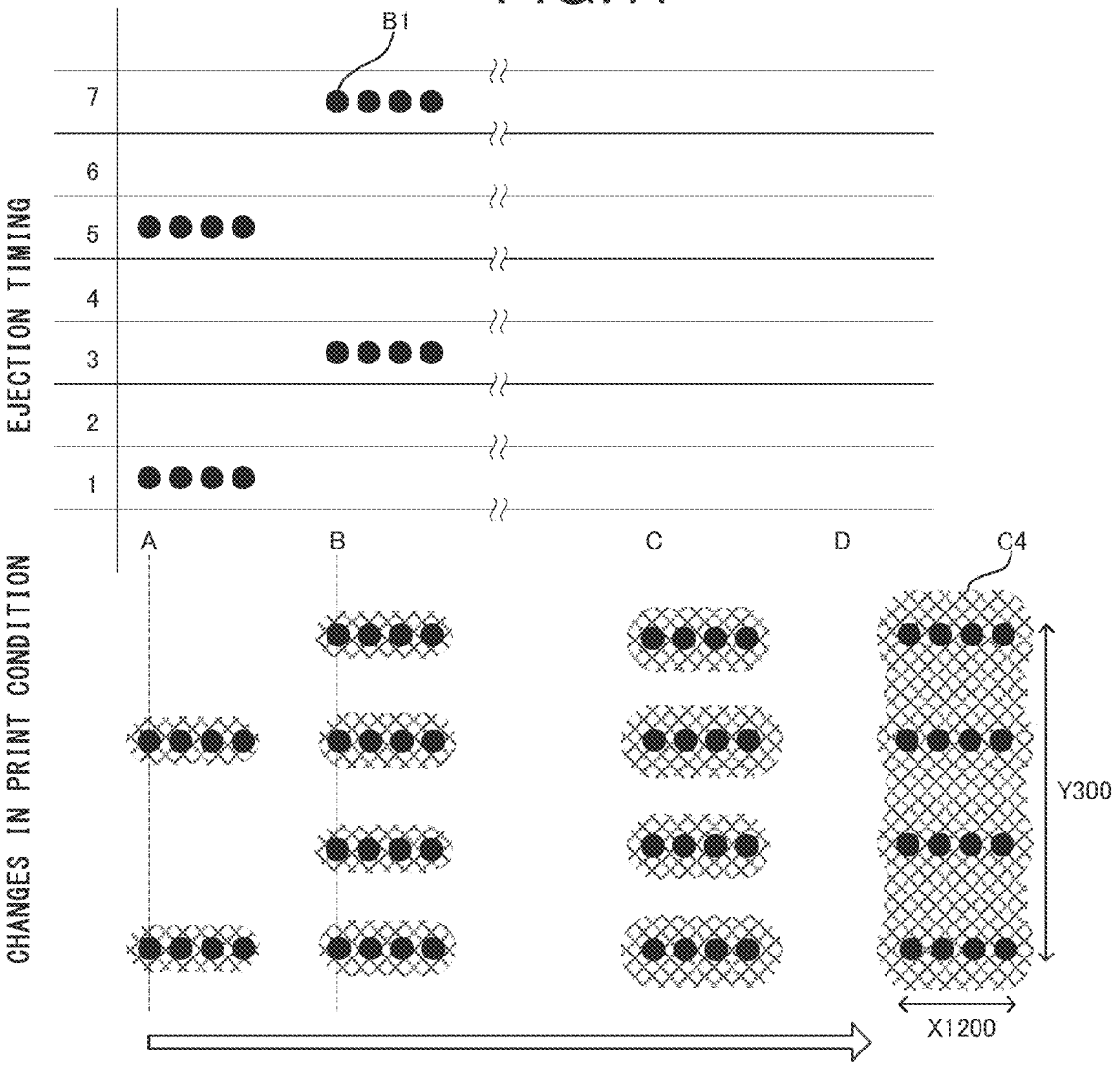
FIG. 11 is a diagram for explaining a fourth printing operation in which two nozzle arrays are used according to the first embodiment.

FIG. 11 illustrates an example in which ink is ejected from each of the nozzles 51 to the tablet T that is moving as conveyed by the conveyor belt 21 using two nozzle arrays A and B to print a straight line C4 (X: 1200 dpi×Y: 300 dpi) as the second straight line extending in the Y direction. The printing of the straight line C4 is performed using a print pattern with a resolution of 1200 dpi in the X direction and 300 dpi in the Y direction. In the example of FIG. 11, ink is ejected from the nozzle arrays A and B at a timing for achieving a resolution of X: 1200 dpi. Therefore, the number of ejections in the X direction in FIG. 11 is twice the number of ejections in the X direction in FIG. 10. Consequently, four ink dots are aligned in the X direction.

First, when the tablet T arrives just under the nozzle array A, ink is ejected from the nozzles 51 in the numbers 1 and 5 in the nozzle array A (first time). Then, ink is further ejected from the nozzles 51 in the numbers 1 and 5 at predetermined intervals (at a predetermined timing) three times. Thus, ink ejection is performed four times in total from the nozzle array A. Thereby, eight ink dots are formed on the surface of the tablet T, and the ink spreads from these ink dots. After that, when the tablet T has moved by the separation distance P from under the nozzle array A, and arrives just under the nozzle array B, ink is ejected from the nozzles 51 in the numbers 3 and 7 in the nozzle array B (first time). Then, ink is further ejected from the nozzles 51 in the numbers 3 and 7 at predetermined intervals (at a predetermined timing) three times. Thus, ink ejection is performed four times in total from the nozzle array B. As a result, in addition to the eight ink dots formed by the nozzle array A, eight ink dots are formed on the surface of the tablet T, and the ink spreads from these ink dots.

In the example of FIG. 11, ink ejection is performed from the nozzle arrays A and B at a timing for achieving a resolution of X: 1200 dpi as described above. Thereby, ink dots are printed at intervals of 1200 dpi in the X direction (conveying direction A1) in four rows. The ink dots are combined as the ink spreads, and finally form a straight line C4 extending in the Y direction. Thus, the straight line C4 extending in the Y direction is printed on the tablet T.

In the example of FIG. 11, more ink dots are formed in the X direction than in the case of FIG. 9. For example, the amount of ink used for X: 1200 dpi printing is twice as much as that for X: 600 dpi printing. Due to the increase in the amount of ink, the ink spreads wider. As a result, ink dots spreads in the Y direction to be combined together, and form a vertical line. That is, differently from the straight line C2 in FIG. 9 that is a coarse line in which ink dots are not combined, the straight line C4 in FIG. 11 is a smooth line in which ink dots are combined.

The timing for the ink ejection in the X direction (conveying direction A1) is determined under the condition that the conveying speed is constant. Accordingly, even when a print pattern is replaced with another one, the conveying speed is unchanged and maintained constant. Besides, when the timing is considered in terms of not time but conveyance distance, in 600 dpi printing, ink is ejected again when the tablet T has moved by 25.4 mm/600 d=0.0423 mm (42.3 μm). In 1200 dpi printing, ink is ejected again when the tablet T has moved by 25.4 mm/1200 d=0.0212 mm (21.2 μm) (4 times in total).

As described above, high-resolution printing can be performed by the use of combinations of a plurality of nozzle arrays A, B, C, and D, in which nozzles are arranged in a staggered manner, for ink ejection. Incidentally, for example, if the tablets T to be printed have a curved surface and the surface is sucked during conveyance, the area sucked and held is smaller as compared to when the surface is flat. Such tablets T are likely to be shaky on the conveyor belt 21 and easily roll over. Accordingly, the position and posture of each of the tablets T are highly likely to change due to the vibration of the conveyor belt 21 or the like. A change in the position and posture of the tablet T causes the displacement of the print position, where a print is applied by the printing device 50, on the tablet T. In particular, when the position and posture change when the tablet T moves between the nozzle arrays, the positions of ink dots landed from the nozzle arrays are mutually misaligned. This results in unclear print of identification information on the tablet T.

As described above, in this embodiment, the separation distance between the nozzle arrays B and C is P×10, which is longer than the separation distance P between the nozzle arrays A and B or between the nozzle arrays C and D. Therefore, the position and posture of the tablet T are more likely to change while the tablet T is moving between the nozzle arrays B and C than while it is moving between the nozzle arrays A and B or between the nozzle arrays C and D.

Meanwhile, the separation distance between the nozzle arrays A and B is P, which is much shorter than the separation distance P×10 between the nozzle arrays B and C. Therefore, when printing is performed with only the two nozzle arrays A and B, the position and posture of the tablets T conveyed by the conveyor belt 21 are less likely to change due to the vibration of the conveyor belt 21 or the like. Even if the conveyor belt 21 vibrates, the shift amount of the tablet T is small since the movement distance of the tablet T between the nozzle arrays is short. Accordingly, the print position is less displaced on the tablet T due to a change in the position and posture of the tablet T. Therefore, in the case of printing with only the nozzle arrays A and B, a decrease in the legibility of identification information printed on the tablet T can be suppressed. Besides, when printing is performed with the two nozzle arrays A and B, the Y-direction resolution (resolution in the array direction of the nozzles 51) is reduced to half of that of printing with the nozzle arrays A, B, C, and D. However, as the X-direction resolution (resolution in the conveying direction A1 of the tablets T) is doubled to compensate it, it is possible to further suppress a decrease in the legibility of identification information printed on the surface of the tablet T.

Incidentally, on the upper side of the conveying device 20, the suction force of the suction chamber 26 is reduced compared to other areas. This is to suppress airflow generation caused by the suction of air from the suction holes 21*a* of the conveyor belt 21. If a high-speed large airflow is generated, ink ejected from the nozzles 51 of the inkjet head 50*a* are bent or blown off by the airflow, resulting in a reduction in print quality. In order to prevent this, the suction force is reduced on the upper side of the conveying device 20, particularly in the area facing the inkjet head 50*a*, as described above. For this reason, the tablets T are liable to shift. On the other hand, on the surface of the conveyor belt 21 around the outer periphery of the driving pulley 22, the suction force of the suction chamber 26 is increased compared to other areas. This is to prevent the tablets T from falling from the surface of the conveyor belt 21 around the outer periphery of the driving pulley 22 due to the centrifugal force.

(Printing Process)

In the following, a description will be given of printing process and inspection process performed by the tablet printing apparatus 1.

First, various information such as print data required for printing is stored in the storage of the control device 90. Then, when a number of tablets T to be printed are put in the hopper 11 of the supply device 10, the tablets T are sequentially supplied from the hopper 11 to the chute 12, and supplied to the conveyor belt 21 as being aligned in a row by the chute 12. The conveyor belt 21 is rotating in the conveying direction A1 with the rotation of the driving pulley 22 and the driven pulleys 23 caused by the motor 24. Accordingly, the tablets T supplied onto the conveyor belt 21 are conveyed at a predetermined moving speed in a row on the conveyor belt 21.

Thereafter, the detecting device 30 detects each of the tablets T on the conveyor belt 21. Thereby, position information (the position in the conveying direction A1) of the tablet T is acquired and fed to the control device 90. The position information of the tablet T is stored in the storage of the control device 90 and used for post-processing. Next, the first imaging device 40 captures an image of the tablet T on the conveyor belt 21 at the timing based on the position information of the tablet T, and sends the image to the image processing device 80. The image processing device 80 generates position shift information of the tablet T (for example, as to the position shift of the tablet T in the X direction, the Y direction, and the θ direction) based on each image received from the first imaging device 40. The position shift information is stored in the storage of the control device 90. The control device 90 sets printing conditions (ejection position and ejection speed of ink, etc.) for the tablet T based on the position shift information of the tablet T. The printing conditions are stored in the storage of the control device 90.

Subsequently, the printing device 50 performs printing on each of the tablets T on the conveyor belt 21 according to the printing conditions at the timing based on the position information of the tablet T, i.e., at the timing when the tablet T reaches under the printing device 50. In the printing device 50, ink is appropriately ejected from each of the nozzles 51. Thus, identification information such as a letter or a character (for example, alphabet, kana character, number), a mark (for example, symbol, figure), or the like is printed on the upper surface of the tablet T.

The second imaging device 60 captures an image of the tablet T having the identification information printed thereon at the timing based on the position information of the tablet T, and sends the image to the image processing device 80. The image processing device 80 generates shape information and print position information indicating the print position of a print pattern for each of the tablets T based on each image received from the second imaging device 60. The shape information and the print position information are stored in the storage of the control device 90. The control device 90 determines print quality as to whether the print on the tablet T is acceptable based on the shape information and the print position information, and stores print quality determination result information indicating the result of the print quality determination for each of the tablets T in the storage thereof. For example, the control device 90 checks whether the print pattern is printed at a predetermined position on the tablet T to determine the print quality.

The tablet T after the inspection is conveyed with the movement of the conveyor belt 21, and arrives at the end of the conveying device 20 on the downstream side in the conveying direction A1. At this position, the tablet T is released from the hold of the conveyor belt 21. As a result, the tablet T is dropped from the conveyor belt 21 and collected by the collecting device 70. For example, if the print quality is acceptable, the tablet T is just dropped and collected by the collecting device 70 as a non-defective product passed with printing. On the other hand, if the print quality is not acceptable, the tablet T is blown by air while dropping and collected by a container other than the collecting device 70 as a defective product that failed printing.

(Print States with Respect to Print Patterns of Various Resolutions)

In the print process, the inkjet printing device 50 performs printing on the tablets T based on a print pattern. Referring to FIGS. 12 to 15, a description will be give of print states with respect to print patterns of various resolutions. FIGS. 12 to 15 illustrate the tablet T on which "A" is printed as identification information.

Figure 12:
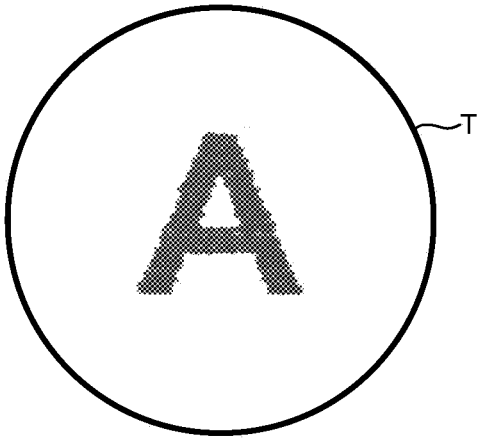
FIG. 12 is a diagram illustrating a tablet (not shifted while moving) on which identification information is printed based on a print pattern of X: 600 dpi×Y: 600 dpi according to the first embodiment.
Figure 13:
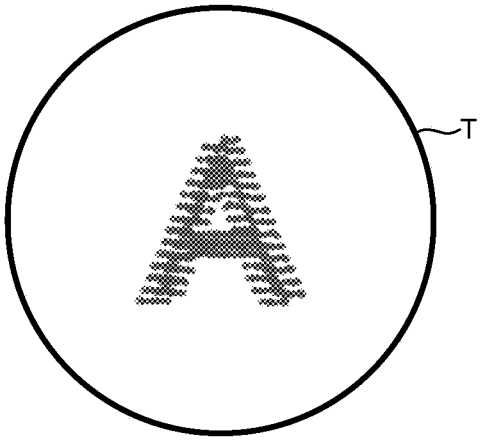
FIG. 13 is a diagram illustrating a tablet (shifted while moving) on which identification information is printed based on a print pattern of X: 600 dpi×Y: 600 dpi according to the first embodiment.

In the case of printing with a print pattern of X: 600 dpi×Y: 600 dpi, all the four nozzle arrays A, B, C, and D are used, and usually "A" is clearly printed on the tablet T as illustrated in FIG. 12. However, among the tablets T in various shapes with various surface conditions, there may be ones on which the print of "A" is wholly misaligned and looks like double printing (ghost printing) as illustrated in FIG. 13. That is, "A" is not always clearly printed, and the print quality may be unstable. Through the observation of misaligned prints as illustrated in FIG. 13, it was found that the misalignment occurred between dots of ink from the two nozzle arrays A and B and dots of ink from the two nozzle arrays C and D. This indicates that the position and posture of the tablets T changed while they were moving between the nozzle arrays B and C.

(Verification by Printing Test)

Figure 14:
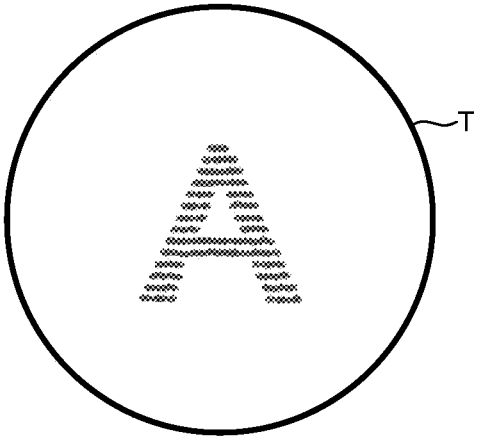
FIG. 14 is a diagram illustrating a tablet on which identification information is printed based on a print pattern of X: 600 dpi×Y: 300 dpi according to the first embodiment.

To verify the above, a printing test was performed on the tablets T on which ghost printing tended to occur using only the two nozzle arrays A and B or the two nozzle arrays C and D. As a result, "A" was printed as illustrated in FIG. 14. No ghost printing as illustrated in FIG. 13 occurred, and the print quality was stable. However, regarding the print state, the print density was low. This is because the Y-direction resolution (resolution in the array direction of the nozzles) was reduced to half (from 600 dpi to 300 dpi) as compared to the print illustrated in FIG. 12, resulting in wider spacing between ink dots of a printed pattern. This is also caused by a decrease in the amount of ink as the number of ink dots applied to the surface of each of the tablets T decreased.

(Study for Sharpening at Low Resolution)

Figure 15:
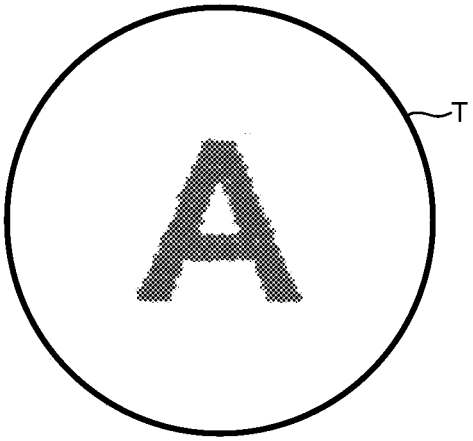
FIG. 15 is a diagram illustrating a tablet on which identification information is printed based on a print pattern of X: 1200 dpi×Y: 300 dpi according to the first embodiment.

Therefore, the present inventors tried using a larger amount of ink to increase the resolution in the conveying direction A1 to thereby increase the print density. The results confirmed that, as illustrated in FIG. 15, the color density of the print can be made equivalent to that in FIG. 12. In addition, it was found that, as the ink spread more, spaces between ink dots were filled with the ink that had spread in the Y-direction (the array direction of the nozzles), and thus the Y-direction resolution (resolution in the array direction of the nozzles) substantially increased.

In view of the foregoing, when the position and posture of the tablets T change while they are moving between the nozzle arrays, a couple of nozzle arrays with a shorter separation distance are used and the print state is adjusted by the X-direction resolution (resolution in the conveying direction A1). Specifically, the X-direction resolution (resolution in the conveying direction A1) is increased to compensate the reduction in the Y-direction resolution (resolution in the array direction of the nozzles) due to the use of less number of nozzle arrays. This is easier than increasing the amount of ink ejected from each of the nozzles 51. Thereby, a clear print can be made stably even on the tablets T having a shape that makes their positions and postures prone to change on the conveyor belt 21. Besides, even if the print state is as illustrated in FIG. 14, printing is performed stably, and the print quality is stable. Therefore, the print state of FIG. 14 is not problematic as long as the print density and the legibility are within their acceptable ranges.

the image processing device 80 generates position shift information for each of the tablets T (information as to the reference position of the tablet T in the XY-coordinate system, i.e., the position shift of the tablet T in the X direction, the Y direction, and the θ direction from the origin) based on each image received from the first imaging device 40. When the tablet T has shifted in the Y direction, the control device 90 shifts (offsets) a print pattern to be used based on the pitch that corresponds to the resolution of the print pattern in the array direction of the nozzles 51 according to the shift amount of the tablet T in the Y direction, and determines the nozzles 51 to be used in each of the nozzle arrays. For example, when printing is performed on the tablets T with the second print pattern, the control device 90 shifts the print pattern by L1/2 since the pitch thereof is L1/2 in the array direction of the nozzles 51, and determines the nozzles 51 to be used in each of the nozzle arrays accordingly.

Specifically, assuming, for example, that the tablet T has shifted by about L3/4 in the +Y direction when printing is performed using the nozzles 51 in the reference numbers 1, 3, and 5 in the nozzle arrays A and B illustrated in FIG. 3, the print pattern is shifted so that the nozzles 51 in the reference numbers 3, 5, and 7 are used. At this time, the control device 90 determines whether to use the nozzles 51 in the reference numbers 3, 5, and 7 or those in the reference numbers 5, 7, and 9 such that the nozzles 51 closer to the using nozzles 51 is selected based on the using nozzle pitch and the shift amount of the tablet T, and the print pattern is offset.

As described above, according to the first embodiment, the inkjet printing device 50 having at least one array of nozzles performs printing at an X-direction resolution (resolution in the conveying direction A1 of the tablets T), which is increased higher than the Y-direction resolution (resolution in the array direction of the nozzles) according to the print density or the print shape on the tablets T. The printing device 50 generates a dot pattern for printing according to the set resolution. In other words, the control device 90 increases either one of the X-direction resolution and the Y-direction resolution for printing higher than the other according to the print density or the print shape on the tablets T, and controls the printing device 50 to perform printing at the resolutions. Thereby, even when the posture and position of the tablets T are prone to change on the conveyor belt 21, a decrease in the legibility of identification information printed on the tablets T can be suppressed. Thus, the misuse of the tablets T can be prevented.

Other Embodiments

In the above embodiment, an example is described in which printing is performed with a print pattern of X: 1200 dpi×Y: 300 dpi using the two nozzle arrays A and B; however, it is not so limited. For example, printing can also be performed with a print pattern of X: 2400 dpi×Y: 150 dpi using the one nozzle array A. In this case, although the Y-direction resolution is reduced, the X-direction resolution is increased to compensate it. Therefore, it is possible to ensure the total amount of ink ejection necessary for clear print results. Further, as an optimum print pattern (dot pattern) is generated for X: 2400 dpi×Y: 150 dpi printing, a decrease in the legibility of identification information printed on the tablets T can be suppressed.

In the above embodiment, an example is described in which printing is performed with a print pattern of X: 1200 dpi×Y: 300 dpi using the two nozzle arrays A and B; however, it is not so limited. Arbitrary combinations of nozzle arrays such as, for example, the nozzle arrays A and C, A and D, and A, C, and D can also be used. Depending on the shape of the tablets T and the distance between the nozzle arrays, the tablets T are less shaky while moving between the nozzle arrays or there is no influence on printing. In such a case, there may be no need to minimize the distance between the nozzle arrays to be used. Depending on the print shape (the shape of a letter or a character, a mark, etc. to be printed or the condition of the shape of the print), the nozzle array(s) that can achieve the best print results may be selected.

In the above embodiment, an example is described in which a new print pattern (dot pattern) is generated each time the resolution is changed; however, it is not so limited. For example, the control device 90 may store print patterns (dot patterns) of possible resolutions in advance and select a specific one of them for use. However, when the resolution is changed to adjust the density, the resolution used may be extremely fine (for example, 657 dpi, 1188 dpi, etc.). In order to select a print pattern, the control device 90 includes a resolution selecting unit (selector: not illustrated) that selects a print pattern (resolution) to be used from a plurality of print patterns of the same identification information with different resolutions according to an input provided by the operator on the input unit 93. The resolution selecting unit may be realized only by hardware such as a circuit, or may be realized by both hardware and software.

In the above embodiment, for example, the total number of ejection times of the first print pattern and the total number of ejection times of the second print pattern are the same; however, this does not necessarily mean that exactly the same amount of ink is ejected in total. It suffices if printing is performed with about the same amount of ink, and the legibility of prints is at about the same level. For example, when printing is performed with a print pattern of X: 1200 dpi×Y: 300 dpi according to the pattern shape of identification information to be printed, the surface condition of the tablets T, the viscosity and drying properties of ink, and the like, the print density may be too high or too low as compared to printing with a print pattern of X: 600 dpi×Y: 600 dpi (even if the same amount of ink is ejected in total), and also the print shape may be deformed. This can be solved by setting the X-direction resolution appropriately. For example, if the Y-direction resolution is 300 dpi, the X-direction resolution is set to a value between 700 dpi and 1400 dpi to adjust the total amount of ejected ink, thereby achieving an appropriate print density or print shape.

Specifically, in the observation of the print state, if the density of print (print density) is low, the X-direction resolution is increased so that a larger more amount of ink is ejected in the X direction. In the above example, the resolution is changed from X: 1200 dpi×Y: 300 dpi to X: 1280 dpi×Y: 300 dpi or the like. On the other hand, when the print density is high, the X-direction resolution is reduced so that less amount of ink is ejected in the X direction. In the above example, the resolution is changed from X: 1200 dpi×Y: 300 dpi to X: 990 dpi×Y: 300 dpi or the like. Besides, when the print shape is not clear due to significant ink feathering or spreading caused by the use of a large amount of ink, the X-direction resolution is reduced so that less amount of ink is ejected in the X direction. In the above example, the resolution is changed to X: 990 dpi×Y: 300 dpi or the like. When the spacing of ink dots is too wide and the print shape is so unclear that it is difficult to read it, in the above example, the resolution is changed to X: 1280 dpi×Y: 300 dpi or the like. By increasing the X-direction resolution, the amount of ink applied is increased so that ink dots are combined. The Y-direction resolution may be similarly changed depending on the print state.

As described above, the Y-direction resolution (resolution in the array direction of the nozzles) is determined by the pitch of the nozzles 51. Therefore, available resolutions are limited as in this embodiment where the use of the four nozzle arrays provides some options of resolution such as 150 dpi, 300 dpi, and 600 dpi. On the other hand, the X-direction resolution (resolution in the conveying direction A1 of the tablets T) is determined by the timing of ink ejection. Thus, the X-direction resolution can be set with a high degree of freedom, thereby achieving finer adjustment of the print density.

Even when printing is performed with a print pattern of X: 600 dpi×Y: 600 dpi, there are cases where the print density may seem too high. This can also be solved by setting the X-direction resolution appropriately. For example, when ink dots are printed using too much ink, the ink takes time to dry. As a result, the ink may adhere to the conveyor belt 21 and other tablets T, thus smearing, or the print may be unclear due to significant ink feathering or spreading. This occurs depending on the surface condition of the tablets T and the properties of the ink. Therefore, the X-direction resolution is set to a value lower than 600 dpi to adjust the total amount of ejected ink, thereby achieving an appropriate print density or print shape. With this, it is possible to reduce defects in prints due to excessive ink amount.

In the above embodiment, the total amount of ink ejected to one tablet T is described as being determined by the number of times of ink ejection in printing with the second print pattern; however, this is by way of example, and it can be adjusted by increasing the amount of ink ejected from the nozzles 51 at one time. The total amount of ejected ink can be determined by both the amount of ink ejected from the nozzles 51 and the number of times of ink ejection. Note that the maximum amount of ink that can be ejected from the one nozzle 51 is already determined. Therefore, assuming that the total amount of ink ejected to one tablet from the nozzles 51 in printing with the first print pattern is the maximum amount per tablet, when printing on each of the tablets T with the second print pattern requires the same or more amount of ink than that with the first print pattern, the total amount of ejected ink has to be adjusted by the number of times of ink ejection.

The total amount of ejected ink can be increased by ejecting ink a plurality of times to the same dot positions in a print pattern (dot pattern). When printing is performed by relative movement, the positions of ink dots are displaced in the relative movement direction. Accordingly, the ink dots at the displaced positions appear as if spreading in the relative movement direction. However, even when the dot of ink spreading in the movement direction by this way lands to one dot in a dot pattern, the resolution of printing is determined by checking the print density and the print shape under this condition, and an optimum dot pattern is generated according to the resolution. Thus, it is possible to suppress a decrease in the legibility of identification information printed on the tablets T.

In the above embodiment, a print head having a plurality of nozzle arrays is described as the inkjet printing device 50; however, this is by way of example and not limitation. For example, the inkjet printing device 50 may be a print head having a single nozzle array. In this case, although the Y-direction resolution decreases, the X-direction resolution can be increased to achieve the total amount of ink ejection necessary for clear print results. With this, a decrease in the legibility of identification information printed on the tablets T can be suppressed. Further, the inkjet printing device 50 may be a plurality of print heads having an array of nozzles arranged in the conveying direction A1 of the tablets T. In this case, the instability of print results is likely to occur but it can be overcome as in the above cases. Thus, it is possible to suppress a decrease in the legibility of identification information printed on the tablets T as in the above embodiment.

In the above embodiment, the print head is described as having four nozzle arrays is described; however, this is by way of example and not limitation. The print head can be provided with any number of nozzle arrays such as, for example, two arrays, three arrays, six arrays, or the like.

In the above embodiment, the separation distance (separation distance in the X direction) between the nozzle arrays B and C is described as being ten times longer than the separation distance P between the nozzle arrays A and B or between the nozzle arrays C and D; however, this is by way of example and not limitation. The separation distance between the nozzle arrays B and C may be the same as (1 time), or 20 times, 30 times longer than the separation distance P. That is, the separation distance between the nozzle arrays B and C includes a distance where the position and posture of the tablets T may change during conveyance.

In the above embodiment, printing with the second print pattern is performed using the nozzle arrays A and B; however, it is not so limited, and it may be performed using the nozzle arrays C and D. Further, the combination of the nozzle arrays A and B and the combination of the nozzle arrays C and D may be switched or alternately used. If printing is performed using the combinations of nozzle arrays alternately in this manner, the life of the nozzles 51 can be extended, and printing can be performed stably. In addition, as the inkjet head 50*a* requires less frequent maintenance, productivity in tablet printing can be improved. When printing is performed with one nozzle array, it may be switched to or used alternately with another nozzle array.

Further, for example, printing with a print pattern of X: 4800 dpi×Y: 75 dpi can be performed using every other nozzles 51 in the nozzle array A. In this case, the nozzles 51 in use can be switched to or used alternately with those not in use. With this, the life of the nozzles 51 can be extended, and printing can be performed stably. In addition, as the inkjet head 50*a* requires less frequent maintenance, productivity in tablet printing can be improved. In this case also, an optimum dot pattern is generated according to the resolution, and clear print results can be achieved.

Incidentally, when printing is performed using every other nozzles of one nozzle array, the resolution is reduced to half. In the case of a plurality of nozzle arrays, printing can be performed using a combination of half of nozzles of the nozzle arrays at a combined resolution. A combination of the nozzles that can achieve the best print results may be determined according to the shape of a letter, a character, a mark, or the like used for printing. In this case, the control device 90 determines nozzle arrays and nozzles in the nozzle arrays used for printing based on a print pattern (dot pattern).

As described above, by adjusting the resolution of printing, i.e., the X-direction resolution and the Y-direction resolution, according to the print density, clear printing can be obtained stably. Thus, it is possible to suppress a decrease in the legibility of identification information printed on the tablets T.

As described above, the setting and the combination of the Y-direction resolution and the X-direction resolution, nozzles or nozzle array(s) to be used and the combination thereof can be determined arbitrarily. In any case, the print density is checked to adjust the Y-direction resolution and the X-direction resolution, and an optimum dot pattern is generated according to the resolutions to perform printing. With this, printing is performed with little decrease in the legibility regardless of the shape of the tablets, the shape of the print pattern, and the structure of the nozzles or the nozzle array(s) of the print head.

In the above embodiment, the tablets T are described as being conveyed in a row; however, this is by way of example, and the number of rows of tablets is not particularly limited. There may be two rows, three rows, or four or more rows.

In the above embodiment, there is provided only one conveyor belt 21; however, this is by way of example, and the number of conveyor belts is not particularly limited. There may be provided two or more conveyor belts. For example, a plurality of conveyor belts 21 may be arranged in parallel.

In the above embodiment, the suction holes 21*a* of the conveyor belt 21 are described as being circular; however, this is by way of example, and the shape of the suction holes 21*a* is not particularly limited. The suction holes may be in a rectangular shape, an elliptical shape, or a slit-like shape.

In the above embodiment, the suction force of the suction chamber 26 is reduced on the upper side of the conveying device 20 as compared to other areas; however, this is by way of example and not limitation. If there is little influence of airflow, which may cause ink ejected from the nozzles 51 of the inkjet head 50*a* to bent or blow off and thereby reduce the print quality, the suction force does not need to be reduced.

In the above embodiment, one inkjet printing device 50 is provided for the conveying path of the tablets T; however, this is by way of example and not limitation. For example, when there are a plurality of conveying paths, the inkjet printing device 50 may be provided for each of the conveying paths.

In the above embodiment, the timing of printing is determined based on position information acquired by the detecting device 30; however, this is by way of example and not limitation. For example, the timing of printing may be determined based on an image captured by the first imaging device 40.

In the above embodiment, the ink applied to the tablets T is left to dry naturally; however, this is by way of example and not limitation. For example, a dryer can be used to dry the ink applied to the tablets T.

In the above embodiment, one conveying device 20 is provided to perform printing on one side of the tablet T; however, this is by way of example and not limitation. For example, two conveying devices 20, each provided with various equipment such as the printing device 50, may be arranged one on top of the other to perform printing on either one or both sides of the tablet T.

The above-described tablets may include tablets for pharmaceutical use, edible use, cleaning, industrial use, and aromatic use. Examples of the tablets include plain tablets (uncoated tablets), sugar-coated tablets, film-coated tablets, enteric coated tablets, gelatin coated tablets, multilayered tablets, dry-coated tablets, and the like. Examples of the tablets further include various capsule tablets such as hard capsules and soft capsules. The tablets may be in a variety of shapes such as, for example, a disk shape, a lens shape, a triangle shape, an elliptical shape, and the like. In the case where tablets to be printed are for pharmaceutical use or edible use, edible ink is suitably used. As the edible ink, any of synthetic dye ink, natural color ink, dye ink, and pigment ink may be used.

While certain embodiments have been described, these embodiments have been presented by way of example only, and are not intended to limit the scope of the inventions. Indeed, the novel embodiments described herein may be embodied in a variety of other forms; further, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A tablet printing apparatus, comprising:

a conveyor configured to convey a tablet;

an inkjet printer including a nozzle array in which a plurality of nozzles are arranged in a direction crossing a conveying path where the tablet is conveyed by the conveyor, and configured to perform printing by ejecting ink from the nozzles to the tablet being conveyed by the conveyor; and a controller configured to increase either one of a resolution in a conveying direction of the tablet at the time of performing the printing and a resolution in an array direction of the nozzles at the time of performing the printing to a resolution higher than the resolution in the other direction according to a print density or a print shape on the tablet, and control the printer to perform the printing.

2. The tablet printing apparatus according to claim 1, wherein the controller is further configured to increase the resolution in the conveying direction of the tablet at the time of performing the printing higher than the resolution in the array direction of the nozzles at the time of performing the printing according to the print density or the print shape on the tablet.

3. The tablet printing apparatus according to claim 2, wherein the printer includes a plurality of nozzle arrays, and the nozzle arrays are mutually shifted in the array direction of the nozzles.

4. The tablet printing apparatus according to claim 2, wherein the total amount of the ink ejected to the tablet when the resolution in the conveying direction of the tablet at the time of performing the printing and the resolution in the array direction of the nozzles at the time of performing the printing are different s the same as the total amount of the ink ejected to the tablet when the resolution in the conveying direction of the tablet and the resolution in the array direction of the nozzles are the same.

5. The tablet printing apparatus according to claim 2, wherein the controller is further configured to reduce the resolution in the conveying direction of the tablet at the time of performing the printing when reducing the print density on the tablet, and increase the resolution in the conveying direction of the tablet at the time of performing the printing when increasing the print density on the tablet, and control the printer to perform the printing.

6. The tablet printing apparatus according to claim 1, wherein the printer includes a plurality of nozzle arrays, and the nozzle arrays are mutually shifted in the array direction of the nozzles.

7. The tablet printing apparatus according to claim 6, wherein total amount of the ink ejected to the tablet when the resolution in the conveying direction of the tablet at the time of performing the printing and the resolution in the array direction of the nozzles at the time of performing the printing are different is the same as the total amount of the ink ejected to the tablet when the resolution in the conveying direction of the tablet and the resolution in the array direction of the nozzles are the same.

8. The tablet printing apparatus according to claim 1, wherein the total amount of the ink ejected to the tablet when the resolution in the conveying direction of the tablet at the time of performing the printing and the resolution in the array direction of the nozzles at the time of performing the printing are different is the same as the total amount of the ink ejected to the tablet when the resolution in the conveying direction of the tablet and the resolution in the array direction of the nozzles are the same.

9. The tablet printing apparatus according to claim 1, wherein the controller is further configured to reduce the resolution in the conveying direction of the tablet at the time of performing the printing when reducing the print density on the tablet, and increase the resolution in the conveying direction of the tablet at the time of performing the printing when increasing the print density on the tablet, and control the printer to perform the printing.

10. The tablet printing apparatus according to claim 1, wherein the controller is further configured to reduce the resolution in the conveying direction of the tablet at the time of performing the printing when the total amount of ink ejected to the tablet is large and the print shape on the tablet is unclear, and increase the resolution in the conveying direction of the tablet at the time of performing the printing when the total amount of ink ejected to the tablet is small and the print shape on the tablet is unclear due to insufficient ejection of the ink, and control the printer to perform the printing.

11. The tablet printing apparatus according to claim 1, wherein the controller is further configured to determine a nozzle to be used from the nozzles based on a pitch that corresponds to the resolution in the array direction of the nozzles at the time of performing the printing according to a shift amount of the tablet in a direction perpendicular to the conveying direction of the tablet in a horizontal plane.

12. A tablet printing method, comprising:

conveying a tablet by a conveyor; and ejecting ink from a plurality of nozzles of an inkjet printer to the tablet being conveyed by the conveyor to perform printing, the printer including a nozzle array in which the nozzles are arranged in a direction crossing a conveying path where the tablet is conveyed by the conveyor;

wherein a controller increases either one of a resolution in a conveying direction of the tablet at the time of performing the printing and a resolution in an array direction of the nozzles at the time of performing the printing to a revolution higher than the resolution in the other direction according to a print density or a print shape on the tablet, and controls the printer to perform the printing.

13. The tablet printing method according to claim 12, wherein the controller increases the resolution in the conveying direction of the tablet at the time of performing the printing higher than the resolution in the array direction of the nozzles at the time of performing the printing according to the print density or the print shape on the tablet.

14. The tablet printing method according to claim 13, wherein the total amount of the ink ejected to the tablet when the resolution in the conveying direction of the tablet at the time of performing the printing and the resolution in the array direction of the nozzles at the time of performing the printing are different is the same as the total amount of the ink ejected to the tablet when the resolution in the conveying direction of the tablet and the resolution in the array direction of the nozzles are the same.

15. The tablet printing method according to claim 13, wherein the controller reduces the resolution in the conveying direction of the tablet at the time of performing the printing when reducing the print density on the tablet, and increases the resolution in the conveying direction of the tablet at the time of performing the printing when increasing the print density on the tablet, and controls the printer to perform the printing.

16. The tablet printing method according to claim 13, wherein the controller reduces the resolution in the conveying direction of the tablet at the time of performing the printing when the total amount of ink ejected to the tablet is large and the print shape on the tablet is unclear, and increase the resolution in the conveying direction of the tablet at the time of performing the printing when the total amount of ink ejected to the tablet is small and the print shape on the tablet is unclear due to insufficient ejection of the ink, and controls the printer to perform the printing.

17. The tablet printing method according to claim 12, wherein the total amount of the ink ejected to the tablet when the resolution in the conveying direction of the tablet at the time of performing the printing and the resolution in the array direction of the nozzles at the time of performing the printing are different is the same as the total amount of the ink ejected to the tablet when the resolution in the conveying direction of the tablet and the resolution in the array direction of the nozzles are the same.

18. The tablet printing method according to claim 12, wherein the controller reduces the resolution in the conveying direction of the tablet at the time of performing the printing when reducing the print density on the tablet, and increases the resolution in the conveying direction of the tablet at the time of performing the printing when increasing the print density on the tablet, and controls the printer to perform the printing.

19. The tablet printing method according to claim 12, wherein the controller reduces the resolution in the conveying direction of the tablet at the time of performing the printing when the total amount of ink ejected to the tablet is large and the print shape on the tablet is unclear, and increase the resolution in the conveying direction of the tablet at the time of performing the printing when the total amount of ink ejected to the tablet is small and the print shape on the tablet is unclear due to insufficient ejection of the ink, and controls the printer to perform the printing.

20. The tablet printing method according to claim 12, wherein the controller determines a nozzle to be used for the printing from the nozzles based on a pitch that corresponds to the resolution in the array direction of the nozzles at the time of performing the printing according to a shift amount of the tablet in a direction perpendicular to the conveying direction of the tablet in a horizontal plane.

* * * * *